United States Patent [19]

Saito et al.

[11] 4,437,947

[45] Mar. 20, 1984

[54] COLD ROLLED STEEL STRIP HAVING AN EXCELLENT PHOSPHATIZING PROPERTY AND PROCESS FOR PRODUCING THE SAME

[75] Inventors: Takao Saito, Himeji; Jyun-ichi Morita, Chita; Kikuji Hirose, Tatsuno; Akitosi Kato, Tokai, all of Japan

[73] Assignee: Nippon Steel Corporation, Tokyo, Japan

[21] Appl. No.: 418,382

[22] Filed: Sep. 15, 1982

Related U.S. Application Data

[63] Continuation of Ser. No. 235,734, Feb. 18, 1981, abandoned.

[30] Foreign Application Priority Data

Feb. 21, 1980 [JP] Japan ..... 55-20851

[51] Int. Cl.[3] ..... C25D 5/44

[52] U.S. Cl. ..... 204/35 R; 204/38 R; 148/6.15 R; 148/6.15 Z

[58] Field of Search ..... 204/35 R, 38 R; 148/6.15 R, 6.15 Z

[56] References Cited

U.S. PATENT DOCUMENTS

| | | | |
|---|---|---|---|
| 2,097,211 | 10/1937 | Tasmar | 148/6.15 |
| 3,444,007 | 5/1969 | Maurer | 148/6.15 R |
| 3,468,724 | 9/1969 | Reinhold | 148/6.15 Z |
| 3,723,162 | 3/1973 | Leontaritis | 148/6.15 R |

FOREIGN PATENT DOCUMENTS

| | | | |
|---|---|---|---|
| 50-51432 | 5/1975 | Japan | 148/6.15 Z |
| 1414484 | 11/1975 | United Kingdom | 148/6.15 Z |

*Primary Examiner*—Sam Silverberg
*Attorney, Agent, or Firm*—Wenderoth, Lind & Ponack

[57] ABSTRACT

A cold rolled steel strip having an excellent phosphatizing property and being capable of firmly bonding with a corrosion-resistant paint coating, comprises a cold rolled steel strip substrate having at least one descaled surface thereof which is substantially free from carbonaceous and oxide substances and; at least one defective metal deposit layer incompletely covering the descaled surface and comprising at least one elementary metal selected from Mn, Ni, Co, Cu and Mo.

5 Claims, 2 Drawing Figures

COLD ROLLED STEEL STRIP HAVING AN EXCELLENT PHOSPHATIZING PROPERTY AND PROCESS FOR PRODUCING THE SAME

This is a continuation application of Ser. No. 235,734, filed Feb. 18, 1981 now abandoned.

BACKGROUND OF THE INVENTION

The present invention relates to a cold rolled steel strip provided with at least one surface thereof having an excellent capability for forming a phosphate film on the above-mentioned surface, and a process for producing the same.

It is known that a cold rolled steel strip is produced by cold rolling a hot rolled steel strip having descaled surfaces thereof. The cold rolled steel strip needs to exhibit a capability of forming a phosphate film on the surface thereof, a capability of firmly bonding with a paint coating having an excellent corrosion-resistance on the surface thereof and other properties necessary when the steel strip is practically used. In order to impart the above-mentioned capabilities and properties to the cold rolled steel strip, usually, the cold rolled steel strip is finished by a process comprising the steps of surface-cleaning, for example, in an electrolytic degreasing procedure; heating the surface-cleaned steel strip, which has been wound to form a coil, to a recrystallizing temperature thereof or more in a reducing atmosphere formed in a batch type box-shaped annealing furnace; uniformly heating the steel strip at the above-mentioned temperature in the reducing atmosphere for a predetermined time; first cooling, in the reducing atmosphere, the uniformly heated steel strip to a temperature at which the surface of the steel strip is never oxidized; removing the first cooled steel strip from the annealing furnace; second cooling the removed steel strip to a temperature at which no aging occurs on the steel strip and; finally, temper rolling the second cooled steel strip.

The capability of forming a phosphate film on a surface of a steel strip when the steel strip is subjected to a phosphate treatment refers, hereinafter, to a phosphatizing property of the steel strip.

The capability of firmly fixing with a paint coating resistant to corrosion, on a surface of a steel strip when the steel strip is coated with a paint, refers, hereinafter, to a corrosion-resistant paint coating-bonding property of the steel strip.

The above-mentioned conventional finishing process includes a number of steps and, therefore, is complicated and sometimes to troublesome in connecting the steps to each other. Also, the heating, uniformly heating and first cooling procedures are successively applied to the coil-formed steel strip in the box-shaped annealing furnace. These procedures cause the finishing process to be prolonged. Therefore the productivity and economic efficiency of the conventional finishing process are unsatisfactory.

Under the above-mentioned circumstances, in order to improve the productivity and economic efficiency of the finishing process, various attempts have been made to simplify and/or continuously carry out the finishing process.

For example, it was attempted to omit the surface-cleaning procedure for the cold-rolled steel strip, from the conventional finishing process. However, the omittance of the surface-cleaning procedure resulted in the disadvantage in that when a rolling oil was applied onto the surface of the steel strip, it was converted to an undesirable carbonaceous substance and fine steel particles formed on the steel strip surface were converted into undesirable oxide substances containing silicon and/or aluminium, during the finishing procedure. These converted carbonaceous and oxide substances were firmly fixed to the steel strip surface, and resulted in a poor corrosion resistance paint coating-fixing property of the steel strip.

In order to eliminate the disadvantages of the above-mentioned attempt and to shorten the annealing process in the box-shaped annealing furnace, Japanese Patent Application Laid-open No. 53-131915(1978) discloses a solution. That is, when a coil-formed steel strip which had been heated to a predetermined temperature, uniformly heated at the predetermined temperature for a predetermined time, was subjected to a cooling procedure, the steel strip having an elevated temperature of 400° to 450° C., was removed from the furnace, and exposed to the air atmosphere so as to rapidly cool the steel strip. This method was effective for enhancing the productivity in the finishing process. Also, since this method resulted in accelerated oxidation of the steel strip surface, the removal of the oxide layer on the steel strip surface by pickling or surface-grinding the surface before the temper rooling procedure, resulted in concurrent removal of the carbonaceous substance and the fine oxidized steel particle containing undesirable impurities, from the surface of the steel strip. Accordingly, this method was effective for obtaining a cold rolled steel strip having a brilliant surface appearance and, also, for enhancing the productivity of the batch type box-shaped annealing furnace. However, it was found by the inventors of the present invention that the above-mentioned method caused the surface of the resultant cold rolled steel strip to exhibit a poor phosphatizing property. Furthermore, it was attempted to continuously carry out the annealing and cooling procedures in order to produce a cold rolled steel strip having an excellent workability at a low cost. Basically, the purpose of this attempt was to control the thermal history of the steel strip created during the annealing and cooling procedures. Firstly, it was attempted to continuously anneal a steel strip in such a manner that a cold rolled steel strip was heated to a recrystallizing temperature of the steel strip or more, first cooled to a predetermined temperature, overaged in a predetermined range of temperature for a predetermined period of time, and, finally, cooled again to room temperature or another predetermined temperature.

However, in order to effect the above-mentioned procedures, it was necessary to provide a very long line of equipment including a steel strip surface-cleaning apparatus, heating apparatus, uniformly heating apparatus, first cooling apparatus, overaging apparatus, second cooling apparatus, drying apparatus and temper rolling apparatus connected to each other is series. This caused the cost of the equipment to be very high. Therefore, it was necessary to decrease the number of heat cycles to be applied to the steel strip and to decrease the amount of equipment.

In order to meet the above-mentioned needs, various experiments were carried out. First, a conventional heat-emitting tube type furnace for heating the cold rolled steel strip was replaced by a direct heating furnace having an enhanced heat transmission. This replacement was effective for increasing the heating rate for the steel strip so as to shorten the heating time for the steel strip. The direct heating furnace was effective for using the heat generated therein to high efficiency. Therefore, the attempted heating procedure could be carried in high thermal efficiency.

Second, in the cooling procedure, the conventional cooling method in which a cooling gas was jetted to the steel strip, was replaced by a new method in which cooling water or a mixture of water and air was used. This new cooling method was effective not only for shortening the cooling time, but also, for shortening the overaging time. Also, in the case where the water-air mixture is used as a cooling medium, since the cooling rate of the steel strip can be varied in a wide range, it was easy to change the cooling rate in response to the quality necessary for the steel strip, which quality is variable depending on the use of the steel strip. Furthermore, it was possible to stop the cooling procedure applied to the steel strip when the steel strip reached the desired temperature. Therefore, in the overaging procedure, it was possible to omit a re-heating procedure for the steel strip to an overaging temperature. Accordingly, it is expected that the above-mentioned cooling method will be widely used in the practical annealing procedure.

When the continuous annealing procedure was carried out, it was possible to produce the cold rolled steel strip in a high efficiency. However, it was found by the inventors of the present invention that even when the steel strip was continuously annealed in a reducing atmosphere by using a conventional cooling medium such as a cooling gas jet, the resultant cold rolled steel strip exhibited a poor phosphatizing property in comparison with that produced by using the conventional box-shaped annealing furnace. Especially, it was found that the poor phosphatizing activity of the steel strip was caused when a rapid heating procedure, using the direct heating furnace, was combined with a rapid cooling procedure by using cooling water or a cooling air-water mixture. The heating procedure in the direct heating furnace and the cooling procedure by using the cooling water or air-water mixture were carried out substantially in an oxidizing atmosphere. Therefore, during the heating and cooling procedures, the surface of the steel sttip was oxidized. Accordingly, it was necessary to remove the oxidized surface portion in at least one stage of the continuous annealing process. The oxidized surface portion produced in the direct heating furnace could be reduced only at an elevated temperature in an ignition furnace. However, when the steel strip was cooled, the surface of the steel strip was oxidized again, and it was difficult to reduce the oxidized surface in an overaging furnace which works at a temperature not high enough to effect the reduction. Therefore, it cannot be expected to decrease the number or duration of heat cycles. Also, if the reduction of the oxidized surface portion of the steel strip was insufficiently carried out, the resultant steel strip exhibited an unsatisfactory corrosion-resistant paint coating-fixing activity. Therefore, it was necessary to remove the oxidized surface portion from the steel strip before the temper rolling procedure, by means of pickling, polishing or grinding. This necessity caused the resultant steel strip to exhibit the same poor phosphatizing property as that of the steel strip which had been produced by annealing it in a box-shaped annealing furnace and by removing the annealed strip from the furnace at an elevated temperature.

An important use of the cold rolled steel strip is in the body of an automobile. In practical use, the automobile body is sometimes corroded. This corrosion creates a safety problem for the automobile. In order to reduce the corrosion of the automobile body, a single-surface coated steel strip, in which a side surface thereof is coated and an opposite side surface thereof is not coated, is used for making the automobile body. The single surface-coating of the steel strip can be made by an electro-plating method or melt-coating method. When the coating is carried out by using the electroplating method, the surface of the steel strip is pickled and, then, plated by passing it through an acid plating solution. The pickling procedure and the acid plating procedure cause the non-plated surface of the resultant plated steel strip to exhibit a poor phosphatizing activity.

Also, in the case of the melt-coating method, it is difficult to prevent at least a portion of the surface not to be coated from being coated with a melt of a metal. Furthermore, since the melt-coating procedure is carried out at an elevated temperature, it is difficult to prevent the oxidation of the surface of the steel strip not to be coated. Therefore, after completing the melt-coating procedure, it is necessary to finish the non-coated surface of the steel strip by means of pickling, polishing or grinding. This finishing procedure causes the non-coated surface of the resultant steel strip to exhibit a poor phosphatizing property.

In order to enhance the phosphatizing property of a steel strip, it is known to spray an aqueous suspension of a sodium phosphate-type phosphatizing activity-enhancing agent, onto a surface of a steel strip, after the steel strip is press-shaped and degreased and before the steel strip is treated with a phosphate. Also, it is known to add a small amount of a heavy metal salt to the phosphate-treating solution in order to promote the reactivity of the phosphate-treating solution itself.

However, when the aqueous suspension-spraying procedure is applied, as a pre-treating procedure, to a press-shaped steel strip, the phosphate-treating procedure is prolonged by the addition of the pre-treating procedure. This prolongation causes the cost of the treating equipment and the cost of the procedure to be increased. Sometimes, the addition of the pre-treating procedure to the phosphate-treating procedure is impossible due to the type of the existing phosphate-treating equipment.

When the heavy metal-containing phosphate-treating solution is applied to a surface of, for example, an automobile body which surface includes a plurality of portions thereof different in chemical reactivity from each other, the results of the phosphate-treatment in each portion of the surface is sometimes different from that of the others. In some portions of the steel strip surface, the formation of the phosphate coating excessively occurs. Also, the addition of the heavy metal salt results in an increase in the cost of the phosphate-treating solution. Furthermore, as a method for enhancing the phosphatizing property of the steel strip, Japanese Patent Application Publication No. 46-7442(1971) discloses that the surface of the cold rolled steel strip is coated with 0.2 to 2 $g/m^2$ of zinc before the phosphate-treating procedure.

However, the paint-coating method used in automobile-manufacturing factories is changing from an anionic electrodeposition method. Therefore, the phosphate-treating agent is changing from hopeite $[Zn_3(PO_4)_2]$ type to phosphophyllite $[Zn_2Fe(PO_4)_2]$ type. However, the conventional zinc-coated cold rolled steel strip does not always exhibit a satisfactory phosphatizing property when the phosphophyllite type phosphate-treatment is applied thereto. Also, when the cationic electrodeposition procedure is applied to the conventional zinc-coated steel strip, hydrogen gas is undesirably generated on the surface of the steel strip so that the resultant paint-coating layer is ballooned by the hydrogen gas. Therefore, the zinc-coating should not be applied to the steel strip surface when the cationic electrodeposition method is applied thereto.

SUMMARY OF THE INVENTION

The object of the present invention is to provide a cold rolled steel strip having an excellent phosphatizing property and being capable of firmly bonding with a corrosion-resistant paint coating, and a process for producing the above-mentioned cold rolled steel strip efficiently.

The above-mentioned object can be attained by the cold rolled steel strip of the present invention which comprises a cold rolled steel strip substrate having at least one descaled surface thereof which is substantially free from carbonaceous and oxide substances and; at least one defective metal deposit layer incompletely covering the descaled surface and comprising at least one elementary metal selected from the group consisting of, manganese, nickel, cobalt, copper and molybdenum.

The above-specified cold rolled steel strip can be produced by the method of the present invention which comprises descaling at least one surface of a cold rolled steel strip substrate to make it free from carbonaceous and oxide substances, and; forming a defective metal deposit layer on said descaled surface of said cold rolled steel strip substrate by depositing at least one transition elementary metal selected from the group consisting of manganese, nickel, cobalt, copper and molybdenum, to incompletely cover the descaled surface.

DETAILED DESCRIPTION OF THE INVENTION

Figure 1:
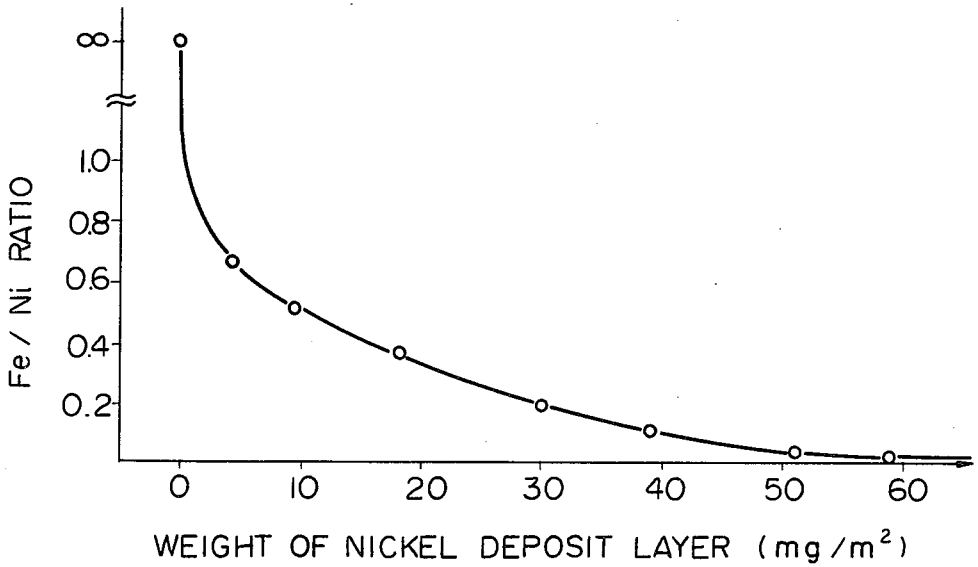
FIG. 1 is a graph showing a relationship between the amount of a nickel deposit layer on a surface of a steel strip substrate and the Fe/Ni ratio which is a ratio of the total area of surface portions of the steel strip substrate which portions are located beneath the defective nickel layer and exposed to the atmosphere, to the total area of the defective nickel layer.

The cold rolled steel strip of the present invention is characterized in that a defective metal deposit layer comprising at least one transition elementary metal selected from Mn, Ni, Co, Cu and Mo is formed on at least one descaled surface of a cold rolled steel strip substrate, which descaled surface is substantially free from carbonaceous and oxide substances.

The carbonaceous substances and the oxide substances containing, for example, Al and/or Si, hinder the formation of a phosphate film on the surface of the cold rolled steel strip when the surface is phosphatized with a phosphate solution. The poor phosphatizing property of the steel strip results in a poor corrosion-resistant paint coating-bonding property of the steel strip. Therefore, in order to obtain a steel strip having an excellent phosphatizing property, it is important that the surface of the steel strip is substantially free from the carbonaceous and oxide substances.

The carbonaceous and oxide substance-free surface can be obtained by descaling the surface. The descaling procedure can be effected by pickling, polishing or grinding the surface.

It was found by the inventors of the present invention that when the descaled surface is incompletely coated by a defective metal deposit layer comprising at least one transition elementary metal selected from Mn, Ni, Co, Cu and Mo, the resultant cold rolled steel strip can exhibit an excellent phosphatizing property.

That is, it is important that the metal deposit layer is defective and does not entirely cover the descaled surface of the cold rolled steel strip substrate. This feature causes portions of the descaled surface of the steel strip substrate to be covered by the defective metal deposit layer and the remaining portions of the descaled surface to be exposed to the atmosphere.

The defective metal deposit layer can enhance the phosphatizing property of the steel strip. It has not yet been completely clarified why the phosphatizing property can be enhanced by the defective metal deposit layer. However, it is assumed that when the cold rolled steel strip having the defective metal deposit layer is immersed in an aqueous phosphate solution, each surface portion of the steel strip substrate which is located beneath the defective metal deposit layer and exposed to the atmosphere, and a surface portion of the defective metal deposit layer adjacent to the exposed steel strip surface portion, form a local electric cell. That is, a number of local electric cells are formed on the surface of the steel strip immersed in the phosphate solution. When the transition elementary metal in the defective metal deposit layer has a higher degree of ionization tendency than that of iron, the metal exhibits a higher dissolving rate into the phosphate solution than that of iron due to the action of the electric cells. Also, when the transition elementary metal in the metal deposit layer exhibits a lower degree of ionization tendency than that of iron, the dissolving rate of iron from the steel strip substrate is higher than that of the transition elementary metal. That is, the formation of the electric cells on the surface of the steel strip can promote the dissolving rate of the transition elementary metal from the metal deposit layer or of iron from the steel strip substrate. In an initial stage of a phosphate treatment procedure, the promotion of the metal or iron dissolution is effective for promoting the formation of phosphate crystal nucleuses around the surface of the steel strip. This phenomenon is effective for promoting the formation of a phosphate film coating on the surface of the steel strip.

Generally, the density of the phosphate crystal nucleuses increases with an increase in the amount of the metal deposit layer formed on the surface of the steel strip substrate. However, an excessive increase in the density of the crystal nucleuses in the phosphate solution results in a decrease in the amount of the phosphate crystal layer deposited on the steel strip substrate surface. The decreased amount of the phosphate layer on the steel strip substrate causes the resultant steel strip to exhibit a poor corrosion-resistant paint coating-bonding property.

Therefore, it is important that the phosphate crystal nucleuses are produced in an appropriate density in the phosphate solution.

In order to produce the phosphate crystal nucleuses in an appropriate density, the action of the local electric cells created on the surface of the steel strip must be appropriate. The action of the electric cells is variable depending on the type of the transition elementary metal used and the degree of of defectiveness of the defective metal deposit layer. The degree of defectiveness of the defective metal deposit layer is also variable depending on the amount and type of the transition metal deposit. Furthermore, the amount of the transition elementary metal deposit which is enough for forming the desired defective metal deposit layer is variable depending on the type of the transition elementary metal used and the type of the phosphate treatment to be applied to the resultant steel strip. Moreover, the amount of the transition elementary metal deposit influences the spot weldability of the resultant steel strip. That is, the increase in the amount of the metal deposit results in decreases in the spot weldability lobes and the spot weld electrode life of the resultant steel strip.

In the case of nickel, it is preferable that the amount of the nickel deposit layer is in a range of from 1 to 50 $mg/m^2$. Especially, in the case where the resultant steel strip is subjected to a phosphophyllite type phosphate treatment and, then, to a cationic electrodeposition type paint coating process, it is preferable that the amount of the nickel deposit layer is in the range of from 1 to 30 $mg/m^2$.

In the case of cobalt or molybdenum, even if the resultant steel strip is subjected to a Hopeite-Phosphophyllite type phosphate treatment, the amount of the cobalt or molybdenum deposit layer should be in the range of from 1 to 500 $mg/m^2$.

In the case of manganese, it is preferable that the amount of the manganese deposit layer is in the range of from 5 to 300 $mg/m^2$. In order to keep the surface of the steel strip brilliant, it is desirable that the amount of the manganese deposit layer does not exceed 300 $mg/m^2$. An excessively large amount of manganese deposit is easily oxidized and degrades the appearance of the steel strip.

When copper is used, it is preferable that the amount of the copper deposit layer is in the range of from 1 to 100 $mg/m^2$. Since the degree of the ionization tendency of copper is lower than that of iron, an excessive amount of copper deposit layer sometimes causes the surface of the steel strip to be rusted during the processing of the steel strip.

When the amount of the metal deposit layer is less than the above-mentioned lower limit, the formation of the phosphate crystal nucleuses is unsatisfactorily promoted. Therefore, the resultant cold rolled steel strip exhibits, a poor phosphatizing property and a poor corrosion resistant paint coating-bonding property.

When the amount of the metal deposit layer is more than the above-mentioned upper limit for each transition elementary metal, sometimes, the resultant metal deposit layer is not defective and completely covers the surface of the steel strip substrate and, therefore, no surface of the steel strip substrate is exposed to the atmosphere. In this case, no electric cell is formed on the surface of the resultant steel strip even when the steel strip is immersed in the phosphate solution. Therefore, the surface of the steel strip exhibits a very poor capability of forming the phosphate crystal nucleuses, and a poor phosphatizing property. Even if the resultant metal deposit layer is defective, the excessively large amount of the metal deposit layer also causes an unsatisfactory exposure of the steel strip surface to the atmosphere. This phenomenon results in a poor formation of the electric cells on the surface of the steel strip and, therefore, in a poor phosphatizing property of the steel strip.

Furthermore, the excessively large amount of the metal deposit layer causes an undesirable generation of gas on the surface of the metal deposit layer. This phenomenon hinders the deposition of the phosphate crystals on the surface of the steel strip and causes the resultant phosphate film coating to be defective. Moreover, the excessively large amount of the metal deposit layer, sometimes, results in such an undesirable phenomenon that the resultant steel strip exhibits decreased spot weldability lobes and a poor spot weld electrode life.

An example of the relationship between the amount of a metal deposit layer formed on the surface of a cold rolled steel strip substrate and the degree of defectiveness of the metal deposit layer is shown in Table 1. In this example, nickel was used for forming the metal deposit layer. The degree of the defectiveness of the nickel deposit layer was represented by the ratio of the total area of the surface portions of the steel strip substrate which portions are located beneath the metal deposit layer and exposed to the atmosphere, to the total area of the metal deposit layer. This ratio is referred to as the Fe/Ni ratio.

The nickel deposit layer was prepared by using the same cathodic electrolytical deposition procedure as that mentioned in Example 1. The amount of the nickel deposit layer was adjusted by adjusting the amount of electric current applied to the cathodic electrolytic composition system. The amount of the nickel deposit layer was determined by an ordinary chemical analysis procedure and the Fe/Ni ratio was determined by means of an X-ray photoelectron spectroscopy (ESCA). The Fe/Ni ratio was represented by a ratio of the peak intensity of Fe to the peak intensity of Ni appearing in the resultant spectrum.

The larger the amount of the nickel deposit layer, the smaller the Fe/Ni ratio. When the Fe/Ni ratio reaches zero, the resultant nickel deposit layer becomes continuous.

A half portion of each of the resultant cold rolled steel strips was treated with a Hopeite-Phosphophyllite type phosphate treating liquid (TA: 15~17, AR: 25~30, $Zn^{++}$: 1000±200 ppm, Treatment I) and, then, paint-coated by using an anionic electrodeposition process. Another half of each cold rolled steel strip was treated with a Phosphophyllite type phosphate treating liquid (TA: 16~18, AR: 18~20, $Zn^{++}$: 1000±200 ppm, $Fe^{++}$: 50~100 ppm, Treatment II), and, then, paint-coated by the cationic electrodeposition process.

In Treatment I, 10 seconds after the start of the treatment, the surface appearance of the steel strip was observed by using a scanning electron microscope to determine the intensity of the formation of the phosphate crystal nucleuses. The phosphate treatment was continued for 120 seconds. The amount of the resultant phosphate layer was determined and the size of the phosphate crystals was measured.

The phosphate-treated steel strip was heated at a temperature of 120° C. for 10 minutes, and, then, paint-coated with an anionic paint by using an anionic electrodepositing method. The paint coated steel strip was baked at a temperature of 180° C. for 30 minutes.

A cross-shaped cut was formed on the paint-coated layer so that the cut reached the surface of the steel strip substrate. The sample was subjected to a corrosion test for 200 hours in accordance with the method defined in JIS Z2371 by using a 5% NaCl solution. After the corrosion test was completed, an adhering tape was adhered onto the cross-shaped cut portion of the paint-coating and it was peeled off from the steel strip. A portion of the paint coating around the cut was separated from the steel strip. The width of the separated portion of the paint coating was measured. The degree of the corrosion resistance of the paint coating was represented by the width of the separated portion of the paint coating.

In Treatment II, the appearance of the phosphate crystal layer was observed 30 seconds after the start of the treatment. The treatment was continued for 120 seconds. The phosphate-treated steel strip was paint-coated with a cationic paint by a using cationic electrodepositing method to form a paint coating having a thickness of about 20 microns. The paint coating was baked at a temperature of 180° C. for 30 minutes.

The resultant paint-coated steel strip was subjected to the corrosion test as mentioned above for 800 hours.

The results are indicated in Table 1.

TABLE 1

| | | | Amount of nickel deposit layer ($mg/m^2$) | | | | | | | |
|---|---|---|---|---|---|---|---|---|---|---|
| | | | 0 | 4 | 9 | 18 | 30 | 39 | 52 | 60 |
| Treatment I | Phosphate film coating | Appearance | remarkably uneven | even | even | even | even | even | even | uneven |
| | | Crystal size (micron) | 150 | 25 | 20 | 25 | 25 | 20 | 10 | 5 |
| | Paint coating | Corrosion-resistance (mm) | 4 | 1 | 1 | 1.5 | 1 | 1 | 2 | 3 |
| Treatment II | Phosphate film coating | Appearance | remarkably uneven | even | even | even | even | slightly uneven | uneven | uneven |
| | | Crystal size (micron) | 50 | 10 | 15 | 10 | 10 | 20 | 40 | 40 |
| | Paint coating | Corrosion-resistance (mm) | 8 | 1 | 1.5 | 1 | 1.5 | 3 | 3 | 3.5 |

FIG. 1 shows that when the amount of the nickel deposit layer exceeds 50 $mg/m^2$, the Fe/Ni ratio approaches zero. That is, the nickel deposit layer becomes continuous.

Table 1 shows that when the amount of the nickel deposit layer is more than 50 $mg/m^2$, the resultant steel strip exhibits an unsatisfactory phosphatizing property and corrosion-resistant paint coating-bonding property.

Table 1 also shows that in the case of Treatment I, 50 $mg/m^2$ or more of a nickel deposit layer caused the size of the phosphate crystals to be excessively small, the amount of the phosphate film coating to be decreased, the evenness of the phosphate film coating to become poor and the corrosion resistance of the paint coating to become poor. However, in the case of Treatment II, it is preferable that the amount of the nickel deposit layer is about 30 $mg/m^2$ or less. As indicated in Table 1, more than about 40 $mg/m^2$ of the nickel deposit layer caused a poor phosphatizing property and corrosion-resistant paint coating-bonding property of the resultant steel strip. That is, in Treatment II, it is necessary that the phosphate film coating be composed of $Zn_2Fe(PO_4)_2$. The supply source of the iron in the above-mentioned phosphate is the steel strip itself. Therefore, the nickel deposit layer needs to be defective so that portions of the steel strip surface are allowed to contact the phosphate treating liquid. In order to meet this need, the defectivity of the nickel deposit layer should provide an area that is appropriately large.

The metal deposit layer can be formed by a conventional cathodic electrolytic deposition process, in which a steel strip is used as a cathode, by using an aqueous solution containing the corresponding metal salt. Also, it is possible to form the metal deposit layer by means of a non electrolytic deposition process, for example, an exchange plating process or a chemical plating process. However, when a non-electrolytic deposition process is used, it is difficult to control the amount of the resultant metal deposit.

In the process of the present invention, at least one surface of the cold rolled steel strip substrate is descaled so as to make the surface free from carbonaceous and oxide substances. Thereafter, a defective metal layer is formed on the descaled surface by means of a cathodic electrolytic deposition by using an aqueous solution of the corresponding metal salt. The metal salt is selected from the water-soluble salts of Mn, Ni, Co, Cu and Mo.

In the case where the descaling procedure is carried out by continuously annealing the steel strip substrate in a reducing atmosphere, the cathodic electrolytic deposition procedure is applied to the steel strip substrate just after emerging from the continuous annealing procedure. Thereafter, the resultant steel strip is washed with water and, finally, dried.

In the case where the steel strip substrate is annealed in a direct-heating furnace and, then, cooled with cold water, hot water or a mixture of air and water in an oxidizing atmosphere, the steel strip substrate which has been removed from the annealing procedure is descaled by a pickling, polishing or grinding procedure so as to remove the carbonaceous and oxide substances from the steel strip substrate surface. Thereafter, the cathodic electrolytic deposition procedure is applied to the descaled steel strip substrate.

In the case where the steel strip substrate is annealed in a box-shaped annealing furnace and, then, discharged from the furnace at an elevated temperature, the annealed steel strip substrate is subjected, before a temper rolling procedure, to a descaling procedure, for example, a pickling, polishing or grinding procedure. Thereafter, the descaled steel strip substrate is subjected to the cathodic electrolytic deposition procedure, washed with water and, finally, dried.

In the case where one surface of a steel strip substrate is galvanized with a melted zinc-based alloy, the non-galvanized surface of the steel strip substrate is descaled by pickling, polishing or grinding it just after the galvanizing procedure. The descaled steel strip substrate is subjected to the cathodic electrolytic deposition procedure, washed with water and, finally, dried.

In the case where one surface of the steel strip substrate is electrolytically plated, the non-plated surface of the steel strip substrate is subjected to the cathodic electrolytic deposition procedure just after the steel strip substrate is plated and washed with water. In this case, both surfaces of the steel strip substrate are descaled before the plating procedure.

Figure 2:
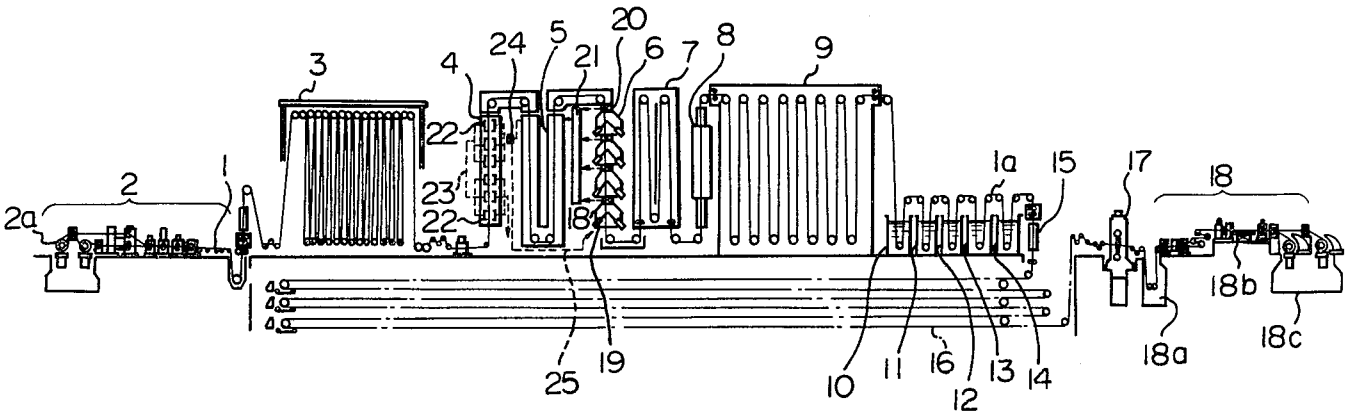
FIG. 2 is an explanatory diagram showing an apparatus for carrying out the process of the present invention.

The process of the present invention can be carried out by using the equipment as indicated in FIG. 2.

Referring to FIG. 2, a cold rolled steel strip substrate 1 in the form of a coil 1*a* is supplied into an inlet handling apparatus 2 including an uncoiler 2*a*, and a shearing machine and a welder (not shown in the drawing), to prepare a uncoiled steel strip substrate to be annealed. The uncoiled steel strip substrate 1 is forwarded to an inlet looper 3, a first preheater 4, a second preheater 5, a jet type direct heating furnace 6, a uniform heating apparatus 7, a first air-water mixture cooler 8, an overaging apparatus 9, a second cooler 10, a pickling apparatus 11, a washing apparatus 12, a cathodic electrolytic depositing apparatus 13, a washing apparatus 14, a dryer 15, an outlet looper 16, a temper rolling machine 17, and, finally an outlet handling apparatus 18 including an oil-applying apparatus 18*a*, a shearing machine 18*b* and a coiler 18*c*.

When the steel strip substrate 1 is introduced into the direct heating furnace 6, the substrate 1 is heated to a temperature of 600° C. or more, preferably, at a heating rate of 40° C./sec or more in a temperature range of 400° C. or more. In order to maintain the heating rate at the level of 40° C./sec or more, irrespective of the thickness of the steel strip substrate, the preheating and direct heating procedures are carried out in the following manner.

A burnt gas having an elevated temperature is generated in the direct heating furnace 6, and discharged from the direct heating furnace 6 through an exhaust gas discharging outlet 20, and introduced into the second preheater 5 through an exhaust gas collecting chamber 21. The exhaust gas from the second preheater 5 is introduced into a recuperator 24 in which a heat exchange from the exhaust gas to burning air to be fed into the direct heating furnace 6 takes place. The heat exchanged exhaust gas from the recuperator 24 is introduced into an upper portion of the first preheater 4 and jetted, as a preheating gas, toward the steel strip substrate 1 through a plurality of nozzle devices 22, so as to preheat the steel strip substrate to a predetermined preheating temperature. Also, the burning air discharged from the recuperation 24 is introduced into a burner 19 of the direct heating furnace 6 through a conduit 25.

The preheating gas jetted through the nozzle devices 22 in the upper portion of the first preheater 4 is collected and introduced into a lower portion of the first preheater 4 through a conduit 23 and jetted toward the steel strip substrate through a plurality of nozzle devices 22. The nozzle devices 22 located in the first preheater 4 can be optionally opened and closed independently from each other. Therefore, the temperature of the steel strip substrate 1 withdrawn from the first preheater 4 can be controlled by controlling the number of the opened nozzle devices and the jetting speed of the preheating gas through the opened nozzle devices. While passing through the first preheater 4, the steel strip substrate 1 is heated from room temperature to an elevated temperature of from 150° to 300° C. When the steel strip substrate has a small thickness, the steel strip substrate is preheated to a low preheating temperature of from 150° to 200° C. by using a decreased number of the nozzle devices and a reduced jetting speed of the preheating gas. When the steel strip substrate has a large thickness, the preheating temperature is controlled in a range of from 250° to 300° C. by using an increased number of the nozzle devices and an increased jetting speed of the preheating gas.

The first preheated steel strip substrate 1 is introduced from the first preheater 4 to the second preheater 5 and preheated by the preheating gas, that is, the exhaust gas from the direct heating furnace 6, to a temperature of from 400° to 500° C. The second preheated steel strip substrate 1 is introduced into the direct heating furnace 6 and heated to a predetermined temperature of 600° C. or more. The direct heating furnace 6 comprises a plurality of burning devices 18 each having a pair of axial stream type slit burners 19. In each burning device 18, a pair of combustion gas streams jetted from the burner 19 are blown onto the surface of the steel strip substrate 1. The fuel to be used in the burners 19 is not limited to a specified type of fuel. For example, a fuel consisting of a coke oven gas (COG) is burnt in the burner 19 at an air ratio of $0.95 \pm 0.05$ so as to elevate the temperature of the furnace 6 to about 1200° C. or more. When the air ratio exceeds 1.0, the oxidation of the surface portion of the steel strip substrate in the direct heating furnace becomes remarkable. Therefore, it is preferable that the air ratio does not exceed 1.0.

The steel strip substrate 1 is heated to a predetermined temperature of 600° C. or more, preferably, from 700° to 860° C., at a heating rate of 40° C./sec. at a temperature of 400° C. or more, for example, 500° C. or more. The heated steel strip substrate is introduced into the uniform heating apparatus 7 in which the temperature of the steel strip substrate is maintained constant, that is, at the predetermined level (700° ~ 860° C.) for 5 to 20 seconds. The uniform heating apparatus may be filled by a reducing atmosphere.

During the uniform heating procedure, the cold rolled steel strip substrate is recrystallized and the size of the crystal grains is increased to a desired size. The uniform heated steel strip substrate is introduced into the first air-water mixture cooler 8 in which the heated steel strip is rapidly cooled to a temperature of from 300° to 500° C. at a cooling rate of 50° C./sec. by using a coolant consisting of an air-water mixture. The purpose of the first cooling procedure is to enhance the degree of oversaturation of solid-dissolved carbon which has been diffused from cementite grains into ferrite grains during the heating and uniform heating procedure, so as to promote the deposition of the solid-dissolved carbon from the grains in the overaging procedure. The first cooling procedure is carried out by using a coolant consisting of an air-water mixture. The use of the air-water mixture causes the control of the terminal point of the cooling procedure to be easy. That is, by using the air-water mixture, the cooling procedure can be easily terminated when the steel strip substrate reaches the same temperature as that of the overaging procedure.

The first cooled steel strip substrate 1 is overaged at a temperature of from 300° to 500° C. for a predetermined time period. The overaging procedure is carried out usually in a non-reducing or oxidizing atmosphere.

The overaged steel strip substrate is rapidly second cooled in the second cooler 10, pickled in the pickling apparatus 11, and, then washed with water in the washing apparatus 12. A descaled steel strip substrate is obtained. A cathodic electrolytic deposition procedure is applied to the descaled steel strip substrate in the cathodic electrolytic depositing apparatus 13 to provide a desired defective metal deposit layer. The resultant steel strip 1*a* is washed with water in the washing apparatus 14 and, then, dried in the dryer 15.

The dried steel strip 1*a* is introduced into a temper rolling procedure by using the temper rolling machine 17. Thereafter, the temper rolled steel strip 1*a* is introduced into the outlet handling apparatus in which the steel strip 1*a* is oiled and coiled.

SPECIFIC EXAMPLES OF THE INVENTION

The following examples are intended to illustrate the application of the process of the present invention, but are not intended to limit the scope of the present invention in any way.

In the examples, four different types of cold rolled steel strips were produced.

Substrate A: A cold rolled steel strip consisting of a continuously casted aluminium killed steel containing 0.05% of carbon, 0.019% of silicon and 0.22% of manganese, and having a thickness of 0.8 mm was annealed and cooled by using the equipment as indicated in FIG. 2, and electrolytically washed, heated in a non-oxidizing atmosphere, uniformly heated in a reducing atmosphere, and rapidly cooled with cooling water. The steel strip had an oxide layer formed on the surface thereof. The oxide layer contained iron oxide in an amount of 300 mg/m$^2$ in terms of iron.

Substrate B: A cold rolled steel strip consisting of a capped steel containing 0.06% of carbon, 0.010% of silicon and 0.31% of manganese was treated in the same manner as that mentioned for Substrate A. Substrate B had an oxide layer containing 380 mg of oxidized iron.

Substrate C: The same type of continuously casted aluminium killed steel strip as that described for Substrate A was uniformly heated in a furnace filled with an atmosphere consisting of HNX and having a dew point of −20° C. at a temperature of 700° C. for 30 seconds, and, then, cooled in the furnace.

Substrate D: The same cold rolled steel strip as that described in Substrate A was electrolytically pickled, uniformly heated in a furnace filled by an atmosphere consisting of HNX and having a dew point of −40° C., at a temperature of 700° C. for 20 hours, cooled to a temperature of 400° C. in the furnace and, then, discharged from the furnace.

EXAMPLE 1

A cold rolled steel strip (Substrate A) was cathodic electrolytically pickled in a 2% sulfuric acid aqueous solution at a temperature of 60° C. by applying a current of 20 amperes/dm$^2$ for 2 seconds, washed with water, squeezed by a pair of rollers and, then, subjected to a cathodic electrolytic deposition procedure. In this procedure, Substrate A was immersed in an aqueous solution containing 3 g/l of $NiSO_4.6H_2O$ and 15 g/l of $(NH_4)_2SO_4$ and having a pH of 4.7 and a temperature of 40° C. and a current of 2 amperes/dm$^2$ was applied to the electrolysis system. The depositing time was 0.1 second (Sample 1), 0.4 seconds (Sample 2), 0.8 seconds (Sample 3), 4 seconds (Sample 4) and 8 seconds (Sample 5).

The amount of the resultant nickel deposit layer in each of Samples 1 through 5 is as indicated in Table 2.

Each sample was washed with water, squeezed by a pair of rollers, dried and, finally, temper rolled at a temperature of 20° C. A temper rolled steel strip was obtained.

Each sample was subjected to a phosphate treatment procedure by using a Hopeite-Phosphophyllite type phosphate solution (TA: 15∼17, AR: 25∼30, $Zn^{++}$: 1000±200 ppm). 10 seconds after the start of the phosphate treatment, the surface appearance of each sample was observed by using a scanning electron microscope at a magnification of 400. The degree of the formation of the phosphate crystal nucleuses is expressed by the following classes.

Class 5: completely even
Class 4: substantially even
Class 3: slightly uneven
Class 2: uneven
Class 1: remarkably uneven The phosphate treatment was carried out for 120 seconds. The amount of the metal deposit layer was determined by a conventional analysis and the size of the phosphate crystals was determined by using a microscopic photograph of the sample surface.

The phosphate treated sample was heated at a temperature of 120° C. for 10 minutes, and, then, paint-coated with a paint (trademark: PW 9600 KOH, made by Nippon Paint Co., Ltd., Japan) by an anionic electrodepositing method, to form a paint coating having a thickness of 20 to 21 microns, and baked at a temperature of 180° C. for 30 minutes.

On the paint coating layer in each sample, a cross-shaped cut was formed so that the cut reached the surface of the substrate. The sample was subjected to a corrosion test in accordance with JIS Z-2371, for 200 hours by using a 5% NaCl aqueous solution. After the corrosion test, an adhering tape was adhered onto the cross-shaped cut portion of the paint coating and peeled out from the sample. A portion of the paint coating around the cross-shaped cut was separated from the substrate together with the peeled adhering tape. The width of the separated portion of the paint coating was measured. The degree of the corrosion-resistance was represented by the width of the separated portion of the paint coating.

EXAMPLE 2

A cold rolled steel strip (Substrate B) was surface ground by using a steel wire brush, washed with water by using a washing brush, squeezed by a pair of squeezing rollers and then subjected to the same cathodic electrolytic deposition procedure as that described in Example 1 for 0.8 seconds, dried and, finally, temper rolled.

The resultant steel strip was subjected to the same phosphate treatment, paint coating and testing procedures as those described in Example 1.

The results are indicated in Table 2.

EXAMPLE 3

A cold rolled steel strip consisting of Substrate C was subjected to the same cathodic electrolytic deposition procedure as that described in Example 2, washed with water, squeezed with a pair of rollers, dried and, finally, temper rolled.

The resultant steel strip was subjected to the same tests as those described in Example 1.

The results are indicated in Table 2.

EXAMPLE 4

A cold rolled steel strip consisting of Substrate D was pickled with a 2% hydrochloric acid aqueous solution for 2 seconds, washed with water and, then, squeezed by a pair of rollers. Thereafter, the steel strip substrate was divided into five pieces and each piece was subjected to a cathodic electrolytic deposition procedure. The decomposition procedure was carried out by using an aqueous solution containing:

$NiSO_4.6H_2O$: 12 g/l
$NiCl_2.6H_2O$: 2.3 g/l
$H_3BO_3$: 1.5 g/l at a temperature of 25° C. and by applying a current of 10 amperes/dm$^2$ for 0.2 seconds (Sample 6), 0.6 seconds (Sample 7), 1.2 seconds (Sample 8), 2 seconds (Sample 9) or 3 seconds (Sample 10).

Each sample was washed with water, squeezed with a pair of rollers, dried and, finally, temper rolled in the same manner as that mentioned in Example 1.

The resultant samples were subjected to the same tests as mentioned in Example 1.

The results are indicated in Table 2.

The resultant steel strip was subjected to the same tests as those described in Example 1. The results are indicated in Table 3.

EXAMPLE 6

The same procedures as those described in Example 1 was carried out, except that the nickel deposition procedure was replaced by the nickel-cobalt deposition procedure which was carried out by using an aqueous solution containing:

$NiSO_4.7H_2O$: 65 g/l
$CoSO_4.7H_2O$: 12 g/l
NaCl: 5 g/l at 3 amperes/dm$^2$ for 0.3 seconds. The resultant nickel-cobalt deposit layer was composed of an equivalent molar amount of nickel and cobalt.

The results are indicated in Table 3.

EXAMPLE 7

The same procedures as those described in Example 3 were carried out, except that the nickel deposition procedure was replaced by the nickel-molybdenum deposition procedure which was carried out by using an aqueous solution containing $NiSO_4.7H_2O$: 60 g/l
$Na_2MoO_4.2H_2O$: 1.5 g/l
Citric acid monohydrate: 72 g/l
NaCl: 1 g/l at one ampere/dm$^2$ for 2 seconds.

The resultant metal deposit layer was composed of 50 molar % of nickel and 50 molar % of molybdenum.

The results are indicated in Table 3.

TABLE 2

| Example No. | | Type of substrate | Ni deposit layer Amount | Phosphate film coating: Appearance (10 seconds deposition) (Class) | Phosphate film coating: 120 second deposition Amount | Phosphate film coating: 120 second deposition Crystal size (micron) | Paint coating Corrosion-resistance |
|---|---|---|---|---|---|---|---|
| Example 1 | Sample 1 | A | 2 mg/m$^2$ | 5 | 2.2 g/m$^2$ | 30 | 1 mm |
| | Sample 2 | A | 4 mg/m$^2$ | 5 | 2.4 g/m$^2$ | 25 | 1 mm |
| | Sample 3 | A | 7 mg/m$^2$ | 5 | 2.1 g/m$^2$ | 20 | 1 mm |
| | Sample 4 | A | 20 mg/m$^2$ | 5 | 2.7 g/m$^2$ | 25 | 1 mm |
| | Sample 5 | A | 50 mg/m$^2$ | 3 | 1.6 g/m$^2$ | 5 | 2 mm |
| Example 2 | | B | 5 mg/m$^2$ | 5 | 2.0 g/m$^2$ | 20 | 1 mm |
| Example 3 | | C | 6 mg/m$^2$ | 5 | 2.3 g/m$^2$ | 25 | 1 mm |
| Example 4 | Sample 6 | D | 8 mg/m$^2$ | 5 | 2.1 g/m$^2$ | 30 | 1 mm |
| | Sample 7 | D | 24 mg/m$^2$ | 5 | 2.4 g/m$^2$ | 25 | 1 mm |
| | Sample 8 | D | 40 mg/m$^2$ | 5 | 2.8 g/m$^2$ | 25 | 1 mm |
| | Sample 9 | D | 60 mg/m$^2$ | 4 | 1.6 g/m$^2$ | 20 | 1 mm |
| | Sample 10 | D | 80 mg/m$^2$ | 3 | 1.2 g/m$^2$ | 10 | 2 mm |

EXAMPLE 5

The same procedures as those described in Example 1 were carried out, except that the nickel deposition procedure was replaced by a cobalt deposition procedure which was carried out by using an aqueous solution containing:

$CoSO_4.7H_2O$: 15 g/l
$(NH_4)_2SO_4$: 75 g/l at 3 amperes/dm$^2$ for 3 seconds.

EXAMPLE 8

The same procedures as those mentioned in Example 1 were carried out, except that the nickel deposition procedure was replaced by a manganese deposition procedure which was carried out by using an aqueous solution containing:

$MnSO_4.H_2O$: 120 g/l
$(NH_4)_2SO_4$: 75 g/l
$Na_2SO_3$: 2.5 g/l at 2 amperes/dm$^2$ for 0.1 seconds (Sample 11), 0.3 seconds (Sample 12), 0.5 seconds (Sample 13), 1 second (Sample 14) or 2.5 seconds (Sample 15).

The results are indicated in Table 3.

TABLE 3

| Example No. | | Type of substrate | Metal deposit layer: Type of metal | Metal deposit layer: Amount | Phosphate film coating: Appearance (10 second deposition) (Class) | Phosphate film coating: 120 second deposition: Amount | Phosphate film coating: 120 second deposition: Crystal size (micron) | Paint coating Corrosion-resistance |
|---|---|---|---|---|---|---|---|---|
| Example 5 | | A | Co | 120 mg/m$^2$ | 5 | 2.5 g/m$^2$ | 25μ | 1 mm |
| Example 6 | | A | Ni—Co (1:1) | 20 mg/m$^2$ | 5 | 2.2 g/m$^2$ | 20μ | 1 mm |
| Example 7 | | C | Ni—Mo (1:1) | 10 mg/m$^2$ | 5 | 2.1 g/m$^2$ | 25μ | 1.5 mm |
| Example 8 | Sample 11 | A | Mn | 3 mg/m$^2$ | 5 | 2.3 g/m$^2$ | 25μ | 1.5 mm |
| | Sample 12 | A | Mn | 9 mg/m$^2$ | 5 | 2.2 g/m$^2$ | 20μ | 1 mm |
| | Sample 13 | A | Mn | 15 mg/m$^2$ | 5 | 2.5 g/m$^2$ | 20μ | 1 mm |
| | Sample 14 | A | Mn | 23 mg/m$^2$ | 5 | 2.7 g/m$^2$ | 25μ | 1 mm |
| | Sample 15 | A | Mn | 35 mg/m$^2$ | 5 | 2.8 g/m$^2$ | 25μ | 1 mm |

EXAMPLE 9

The same procedures as those described in Example 4 were carried out, except that the nickel deposition procedure was replaced by a manganese deposition procedure identical to that described in Example 8.

The results are indicated in Table 4.

EXAMPLE 10

Procedures identical to those described in Example 3 were carried out, except that the nickel deposition procedure was replaced by the same manganese deposition procedure as that mentioned in Example 8, in which an electric current was applied at 3 amperes/dm$^2$ for 2 seconds.

The results are indicated in Table 4.

EXAMPLE 11

The same procedures as those mentioned in Example 1 were carried out, except that the nickel deposition procedure was replaced by the copper deposition procedure which was carried out by using an aqueous solution containing:

$CuSO_4.5H_2O$: 60 g/l

Sulfuric acid (98%): 15 g/l at a current density of 3 amperes/dm$^2$ for 0.3 seconds.

The results are indicated in Table 4.

EXAMPLE 12

The same procedures as those described in Example 3 were carried out, except that the nickel deposition procedure was replaced by the copper deposition procedure which was carried out in the same manner as that described in Example 11, at a current density of 5 amperes/dm$^2$ for one second.

The results are indicated in Table 4.

COMPARISON EXAMPLE 1

The same procedures as those described in Example 1 were carried out, except that no nickel deposition procedure was applied to the steel strip substrate.

The results are indicated in Table 5.

COMPARISON EXAMPLE 2

The same procedures as those described in Example 2 were carried out, except that no nickel deposition procedure was applied to the steel strip substrate.

The results are indicated in Table 5.

COMPARISON EXAMPLE 3

The same procedures as those described in Example 3 were carried out, except that no nickel deposition procedure was applied to the steel strip substrate.

The results are indicated in Table 5.

COMPARISON EXAMPLE 4

The same procedures as those described in Example 3 were carried out, except that no nickel deposition procedure was applied to the steel strip substrate (Substrate C), and the steel strip substrate was cathode-electrolytically pickled in a 2% sulfuric acid aqueous solution at a temperature of 60° C. at a current density of 10 amperes/dm$^2$ for one second, before the water-washing procedure.

The results are indicated in Table 5.

COMPARISON EXAMPLE 5

The same procedures as those described in Example 4 were carried out, except that no nickel deposition procedure was applied to the steel strip substrate.

The results are indicated in Table 5.

COMPARISON EXAMPLE 6

The same procedures as those described in Example 1 were carried out, except that the pickled steel strip substrate (Substrate A) was uniformly annealed in a

TABLE 4

| Example No. | Type of substrate | Metal deposit layer: Type of metal | Metal deposit layer: Amount | Phosphate film coating: Appearance (10 second deposition) (Class) | Phosphate film coating: 120 second deposition: Amount | Phosphate film coating: 120 second deposition: Crystal size (micron) | Paint coating Corrosion-resistance |
|---|---|---|---|---|---|---|---|
| Example 9 | D | Mn | 12 mg/m$^2$ | 5 | 2.3 g/m$^2$ | 25μ | 1 mm |
| Example 10 | C | Mn | 150 mg/m$^2$ | 5 | 2.1 g/m$^2$ | 20μ | 1.5 mm |
| Example 11 | A | Cu | 25 mg/m$^2$ | 5 | 2.1 g/m$^2$ | 25μ | 1 mm |
| Example 12 | C | Cu | 99 mg/m$^2$ | 4 | 2.2 g/m$^2$ | 20μ | 1 mm |

reducing atmosphere consisting of HNX and having a dew point of −40° C. by maintaining the temperature of the steel strip substrate at 700° C. for 20 hours by using a box-shaped annealing furnace, cooled within the above-mentioned furnace down to 100° C. or less, and then, removed from the furnace into the atmosphere, and no nickel deposition procedure was applied to the steel strip substrate.

The results are indicated in Table 5.

COMPARISON EXAMPLE 7

The same procedures as those described in Example 2 were carried out, except that a steel wire brush-grinding procedure was replaced by the same cathode electrolytic pickling procedure as that described in Example 1; the pickled steel strip substrate (Substrate B) was annealed in the same manner as that described in Comparison Example 6, and; no nickel deposition procedure was applied to the steel strip substrate.

The results are indicated in Table 5.

TABLE 5

| | | Phosphate film coating | | | |
|---|---|---|---|---|---|
| | | | 120 second deposition | | |
| Comparison Example No. | Type of substrate | Appearance (10 second deposition) (Class) | Amount | Crystal size (micron) | Paint coating Corrosion-resistance |
| 1 | A | 1 | 4.5 g/m$^2$ | 100μ | 4 mm |
| 2 | B | 1 | 5.2 g/m$^2$ | 100μ | 5 mm |
| 3 | C | 1 | 5.0 g/m$^2$ | 180μ | 4 mm |
| 4 | C | 1 | 4.3 g/m$^2$ | 150μ | 5 mm |
| 5 | D | 1 | 4.9 g/m$^2$ | 120μ | 5 mm |
| 6 | A | 5 | 2.2 g/m$^2$ | 20μ | 1 mm |
| 7 | B | 5 | 2.5 g/m$^2$ | 25μ | 1 mm |

We claim:

1. A process for producing a cold-rolled steel strip having an excellent bonding property with a corrosion-resistant paint coating, comprising the steps of:

descaling at least one surface of a cold-rolled steel strip substrate to such an extent that the surface becomes substantially free from carbonaceous and oxide substances;

forming metallic nuclei scattered on said descaled surface of said cold-rolled steel strip substrate by depositing at least one transition elementary metal selected from the group consisting of manganese in an amount of 5 to 300 mg/m$^2$, nickel in an amount of 1 to 50 mg/m$^2$, cobalt in an amount of 1 to 500 mg/m$^2$, copper in an amount of 1 to 100 mg/m$^2$, and molybdenum in an amount of 1 to 500 mg/m$^2$, by means of cathodic electrolytic decomposition applied to an aqueous solution containing the corresponding metal salt, to such an extent that portions of said descaled surface of said steel strip are covered by said metallic nuclei and the remaining portions of said steel strip surface are free from said metallic nuclei and are exposed to the atmosphere; and immersing said steel strip having said metallic nuclei in an aqueous solution of a phosphate to form a phosphate coating on said steel strip surface.

2. A process as claimed in claim 1, wherein said descaling procedure is carried out by pickling said surface of said cold-rolled steel strip substrate.

3. A process as claimed in claim 1, wherein said descaling procedure is carried out by continuously annealing said cold-rolled steel strip substrate in a reducing atmosphere.

4. A process as claimed in claim 1, wherein said descaling procedure is carried out by polishing or grinding said surface of said cold-rolled steel strip substrate.

5. A cold-rolled steel strip produced by the process as claimed in claim 1.

* * * * *